US005689832A

United States Patent [19]

Head

[11] Patent Number: 5,689,832

[45] Date of Patent: Nov. 25, 1997

[54] SAGGING DOUBLE BOTTOM PANTS

[75] Inventor: James T. Head, Hayward, Calif.

[73] Assignees: Thurston Bilal, Hollywood; Robert Lee Rodgers, Newark, both of Calif.; a part interest

[21] Appl. No.: 626,377

[22] Filed: Apr. 2, 1996

[51] Int. Cl.[6] ..... A41D 1/06

[52] U.S. Cl. ..... 2/227; 2/236; 2/307

[58] Field of Search ..... 2/227, 236, 307, 2/242, 22, 23; D2/742

[56] References Cited

U.S. PATENT DOCUMENTS

| | | | |
|---|---|---|---|
| D. 140,465 | 2/1945 | Kotzin | D2/742 |
| D. 262,325 | 12/1981 | Miller et al. | D2/28 |
| 3,435,462 | 4/1969 | Bank | 2/227 X |
| 4,282,608 | 8/1981 | Amberg | 2/227 |
| 4,561,121 | 12/1985 | Ehring et al. | 2/2 |
| 4,989,272 | 2/1991 | Wagner | 2/227 |
| 5,010,595 | 4/1991 | Stradley | 2/227 |
| 5,033,126 | 7/1991 | Wruck et al. | 2/242 |
| 5,068,920 | 12/1991 | Bray | 2/227 X |
| 5,168,582 | 12/1992 | Aldridge | 2/305 |
| 5,219,367 | 6/1993 | Fields | 2/227 |
| 5,289,590 | 3/1994 | Larson | 2/227 |

*Primary Examiner*—C. D. Crowder
*Assistant Examiner*—Shirra L. Jenkins
*Attorney, Agent, or Firm*—Jacobson, Price, Holman & Stern, PLLC

[57] ABSTRACT

A sagging double bottom incorporated into a conventional pair of trousers, pants or the like. The sagging double bottom is an added separate layer of matching fabric material overlying the rear surface areas of the trousers or pants. The added layer of fabric material covers the rear surface portions of the upper end portion of each leg and the seat portion of the trousers or pants and is attached to the trousers or pants along the side seams, along the inseams and center seam in the crotch area. The lower edge of the leg portions of the added fabric layer is attached transversely of the rear portion of the trousers or pants leg by a conventional seam. The upper edge of the added fabric layer terminates in an auxiliary waistband matching the waistband of the trousers or pants and has its ends incorporated into the side seams at a point spaced below the waistband of the trousers or pants. The auxiliary waistband is longer than the waistband of the trousers or pants and is stitched into the side seams in a manner to support the auxiliary waistband at the upper edge of the added fabric layer in a downwardly extending arcuate configuration.

13 Claims, 8 Drawing Sheets

SAGGING DOUBLE BOTTOM PANTS

BACKGROUND OF THE INVENTION

1. Field of the Invention

The present invention generally relates to a garment structure of the type generally referred to as trousers, pants, jeans or dungarees and more specifically to the provision of a sagging double bottom incorporated into a conventional pair of trousers, pants or the like.

2. Description of the Prior Art

Garment structures such as trousers, pants, jeans and dungarees have been constructed of various materials and in various constructions depending upon the appearance characteristics desired and the wear characteristics desired. Various pocket arrangements have been provided and leg constructions utilized. For example, in some trousers, the legs are tapered downwardly and inwardly, in some the legs are flared downwardly and outwardly, and in others the legs are simply of straight construction. In recent years, various garments including trousers, pants, jeans or dungarees have been worn by individuals to obtain a particular external appearance characteristic sometimes referred to as a "fashion statement". In some instances, garments of this type which are oversize have been worn to enable the rear portion of the waistband to sag substantially below the normal position of a waistband when it encircles the waist of a wearer. The downwardly sagging rearward portion of the waistband generally assumes an arcuate configuration having a top edge located across the buttock area of the wearer. Due to the oversize of the waistband, trousers or pants worn in this manner sometimes inadvertently fall or are pulled downwardly to an extent to expose portions of the human anatomy normally intended to be covered by trousers or pants.

The prior art in this field of endeavor includes trousers or pants of multiple layers which include inner liners, multilayered trousers connected together with a single waistband at the upper end as well as trousers or pants having multiple colors incorporated therein. The following U.S. patents disclose developments in trousers or pants of this type:

| | |
|---|---|
| 4,282,608 | 5,168,582 |
| 4,561,121 | 5,289,590 |
| 4,989,272 | D262,325 |
| 5,010,595 | |

The prior art however, does not disclose trousers, pants, jeans or dungarees having a sagging double bottom in accordance with the structure in this application.

SUMMARY OF THE INVENTION

More specifically, the present invention provides its own fashion statement by incorporating a sagging double bottom onto the back side of an otherwise conventional pair of trousers, pants or the like, especially jeans and more particularly bluejeans. The sagging double bottom is an added separate layer of fabric material overlying the rear surface areas of the trousers or pants. The added layer of fabric material covers the seat portion of the trousers or pants, as well as preferably the rear surface portions of the upper end portion of each leg. The added fabric layer is attached to the trousers or pants along the side seams and along the inseams up to and including the center seam in the crotch area. The lower edges of the leg portions of the added fabric layer are preferably attached transversely of the rear portion of the trousers or pants leg by a conventional seam across the back of the pants legs.

The upper edge of the added fabric layer terminates in an auxiliary waistband that simulates a conventional waistband with belt loops to match the waistband of the existing pants. The auxiliary waistband has its ends incorporated into the side seams of the trousers or pants preferably at a point spaced below the existing waistband of the trousers or pants and is longer than the waistband of the trousers or pants. The upper edge of the added fabric layer is also stitched into the side seams in a manner to support the auxiliary waistband at the upper edge of the added fabric layer and in a downwardly extending arcuate configuration so that the auxiliary waistband tends to remain arcuate in configuration when the trousers or pants are worn by the wearer. The length of the auxiliary waistband is substantially longer than the length of a corresponding portion of the existing waistband on the trousers or pants, thus providing an upwardly opening compartment between the rear surface of the trousers or pants and the added fabric layer with its auxiliary waistband.

In the preferred embodiment, the auxiliary waistband is positioned with its upper edge below the upper end of rear pockets on the trousers or pants and the added fabric layer includes additional rear pockets positioned below the auxiliary waistband to match the rear pockets in the existing pants. Thus, the addition of the separate fabric layer to the rear of otherwise conventional trousers or pants can provide a garment with a double bottom which has an upper end that sags below the existing waistband and provides access to a compartment between the existing fabric layer of the trousers or pants and the added layer of fabric material. It is also contemplated that the sagging double bottom construction of the present invention can also be incorporated into shorts as well as long pants and the like.

Therefore, it is an object of the present invention to provide sagging double bottom pants (or shorts) having an added fabric layer overlying the seat and preferably the upper end portion of the legs of conventional pants with the periphery of the added layer, except the top edge, being connected to the existing pants by conventional seams or stitching. The upper edge of the double bottom is provided with an auxiliary waistband having its ends connected to the side seams of the existing pants adjacent the existing waistband.

Another object of the present invention is to provide a sagging double bottom for pants, especially jeans and bluejeans, as set forth in the preceding object in which the auxiliary waistband has a length greater than the corresponding portion of the existing waistband on the pants to provide an arcuately, downwardly extending auxiliary waistband which is connected only at the side seams of the existing pants to simulate a sagging waistband on a pair of trousers, pants, jeans, dungarees or shorts when worn by the wearer.

A further object of the present invention is to provide sagging bottom pants in which the periphery of the added layer of fabric material, other than the top edge, is continuously secured to the side seam, across the rear portion of the legs of the existing pants and upwardly along the inseams to the crotch area with the added layer of fabric material also including pockets on the exterior thereof and a center seam extending from the crotch area to the center of the auxiliary waistband to provide a compartment between the added layer and the existing pants that is accessible from the top edge of the auxiliary waistband with the compartment being laterally continuous from one side seam to the other and extending downwardly to the bottom end of the leg portions of the double bottom.

A still further object of the present invention is to provide a sagging bottom for trousers, pants or shorts, in accordance with the preceding objects, which is of simple design and construction and can be easily and economically manufactured using known manufacturing techniques.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
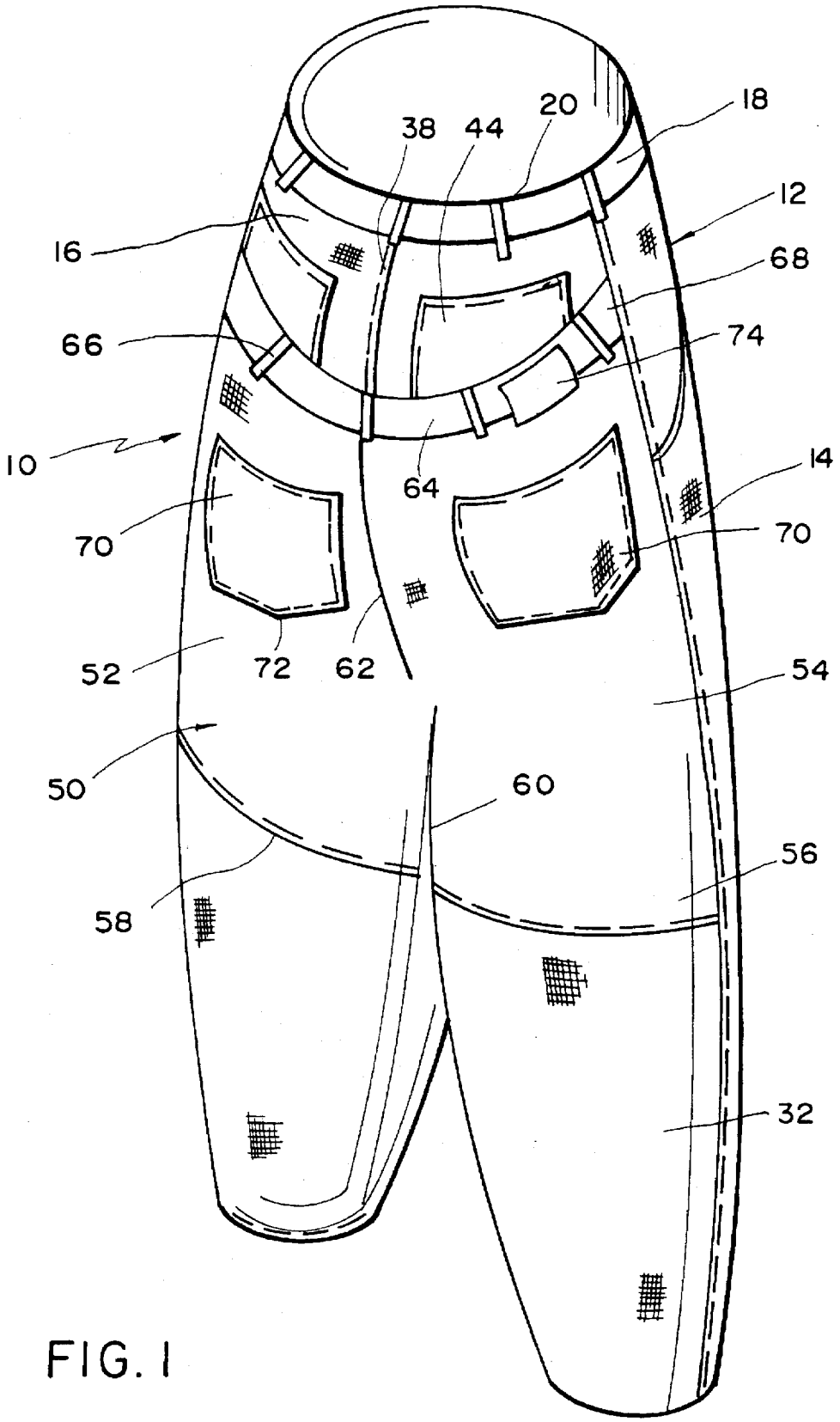
FIG. 1 is a rear perspective view of the sagging double bottom pants in accordance with a preferred embodiment of the present invention, illustrating the relationship of the double bottom to existing pants.
Figure 2:
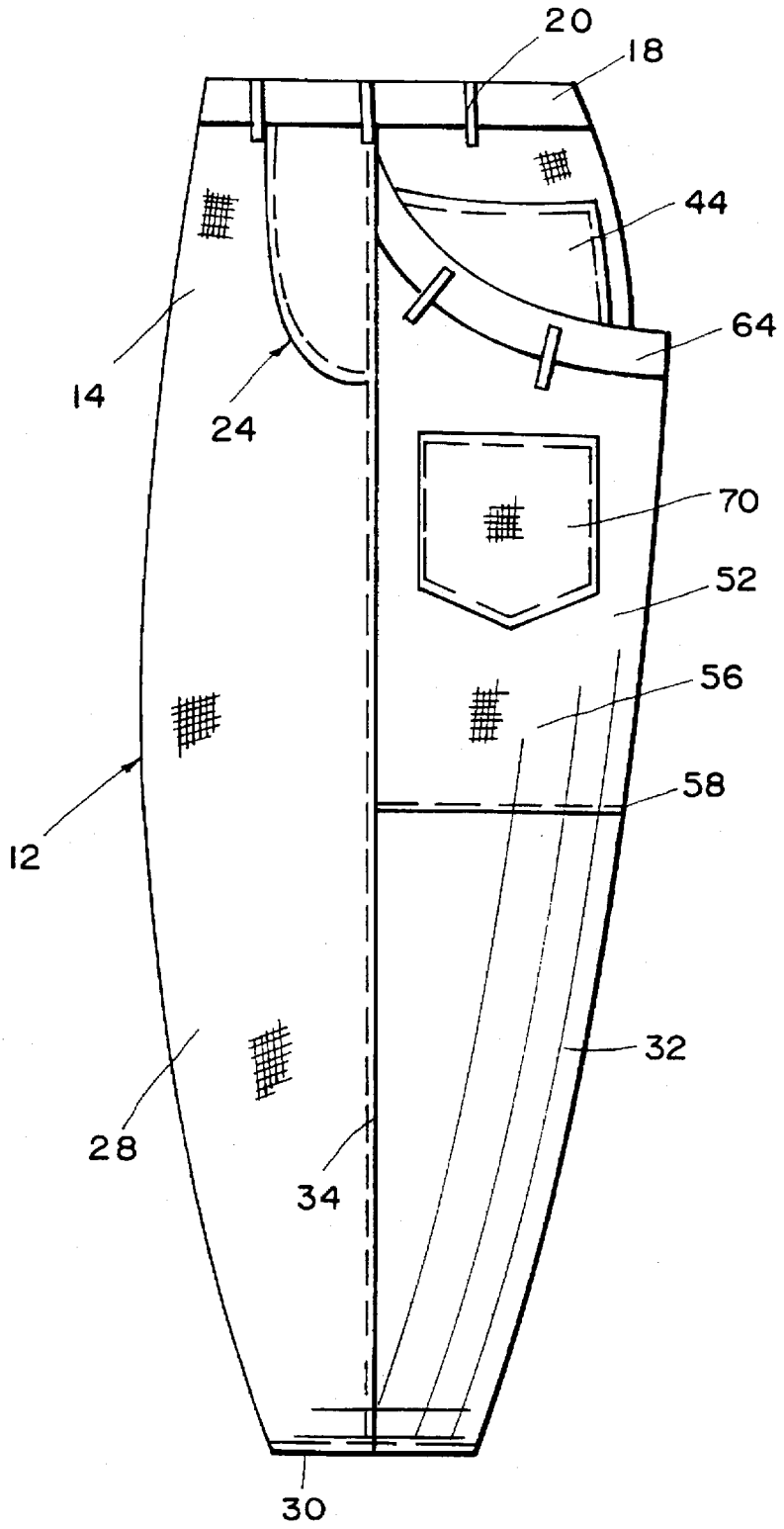
FIG. 2 is a side elevational view of the pants of FIG. 1 from the left side.
Figure 3:
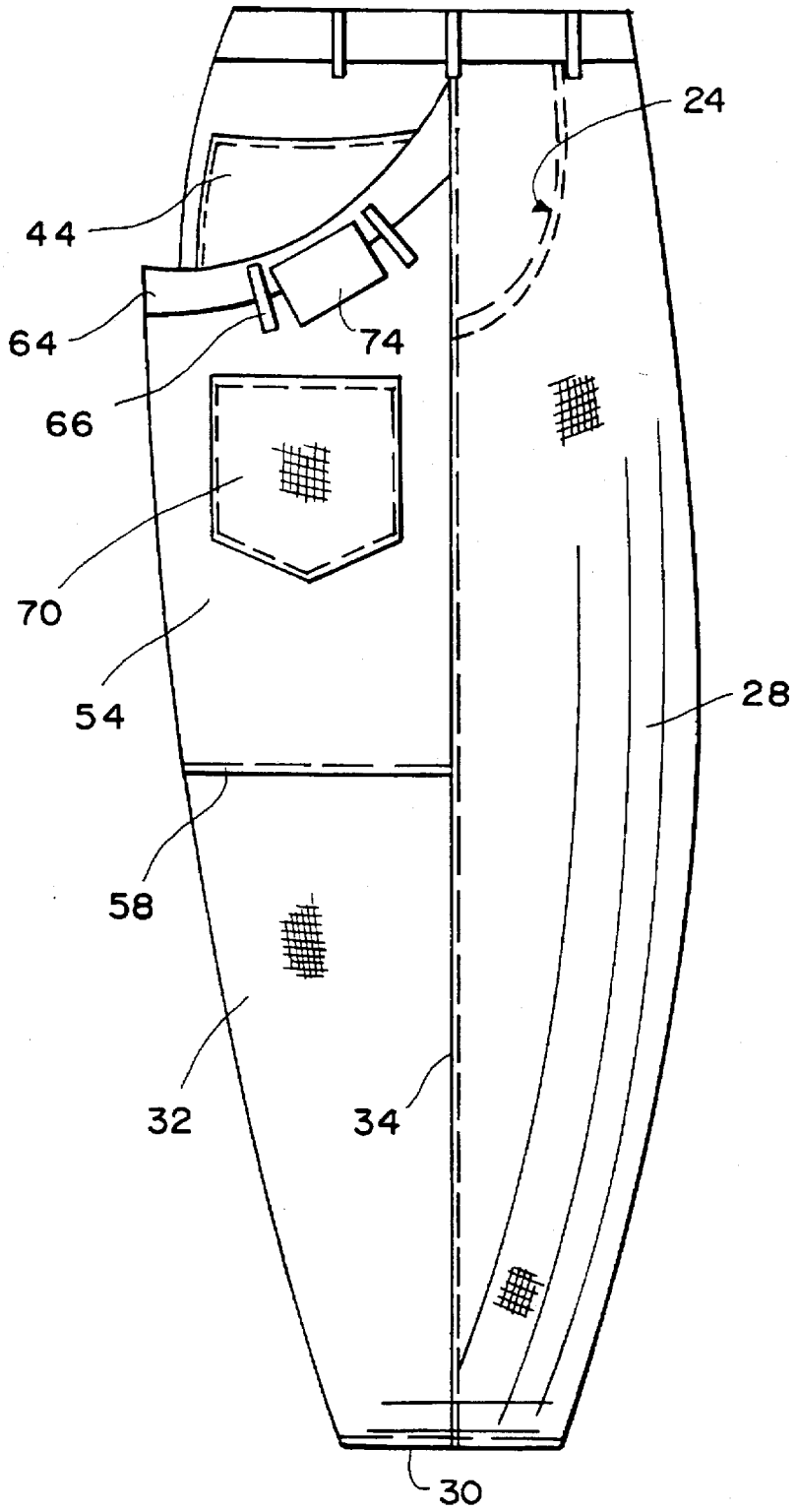
FIG. 3 is a side elevational view of the pants of FIG. 1 from the right side.
Figure 4:
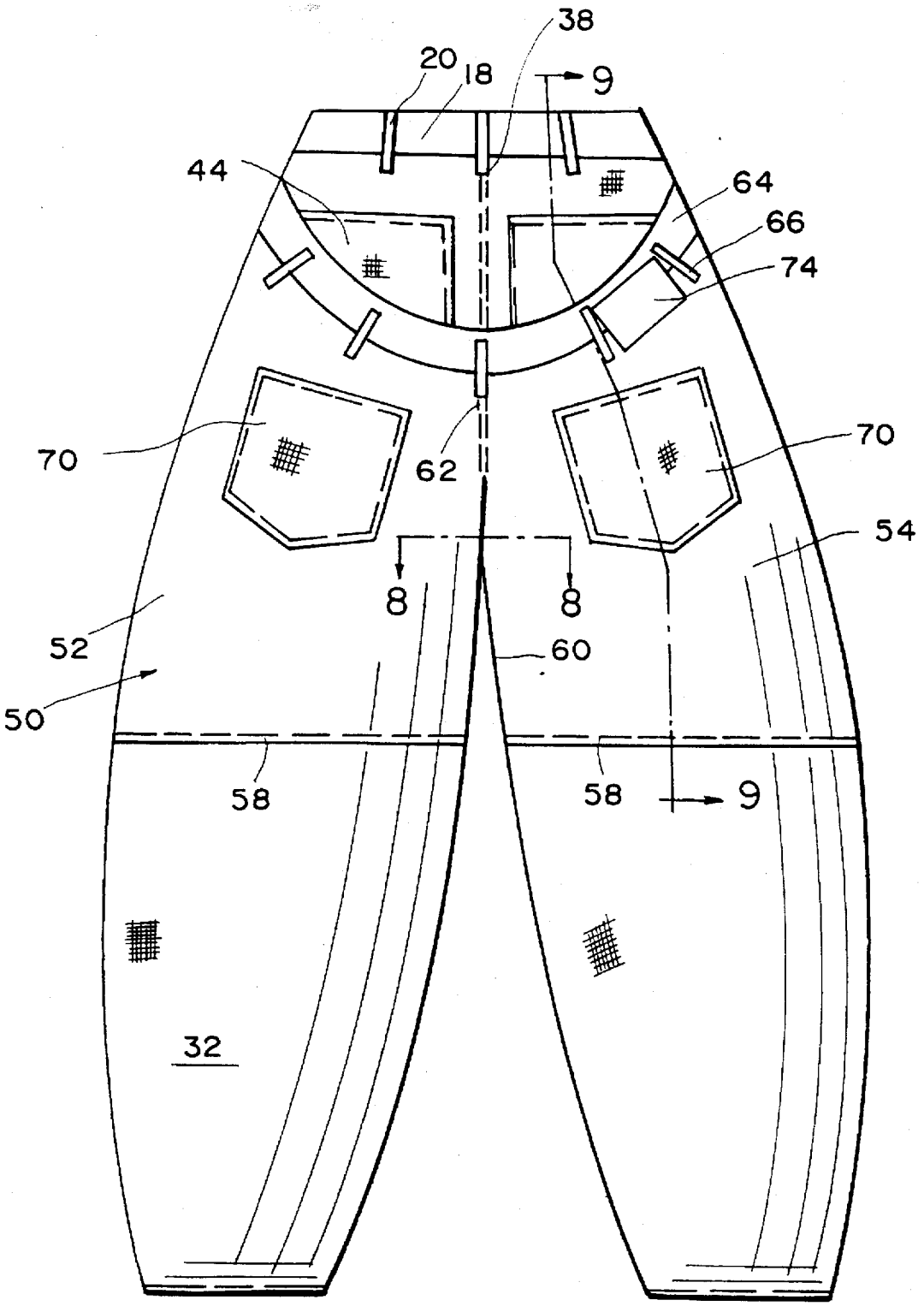
FIG. 4 is a rear elevational view of the pants of FIG. 1, illustrating further relationships between the sagging double bottom and the existing pants.
Figure 5:
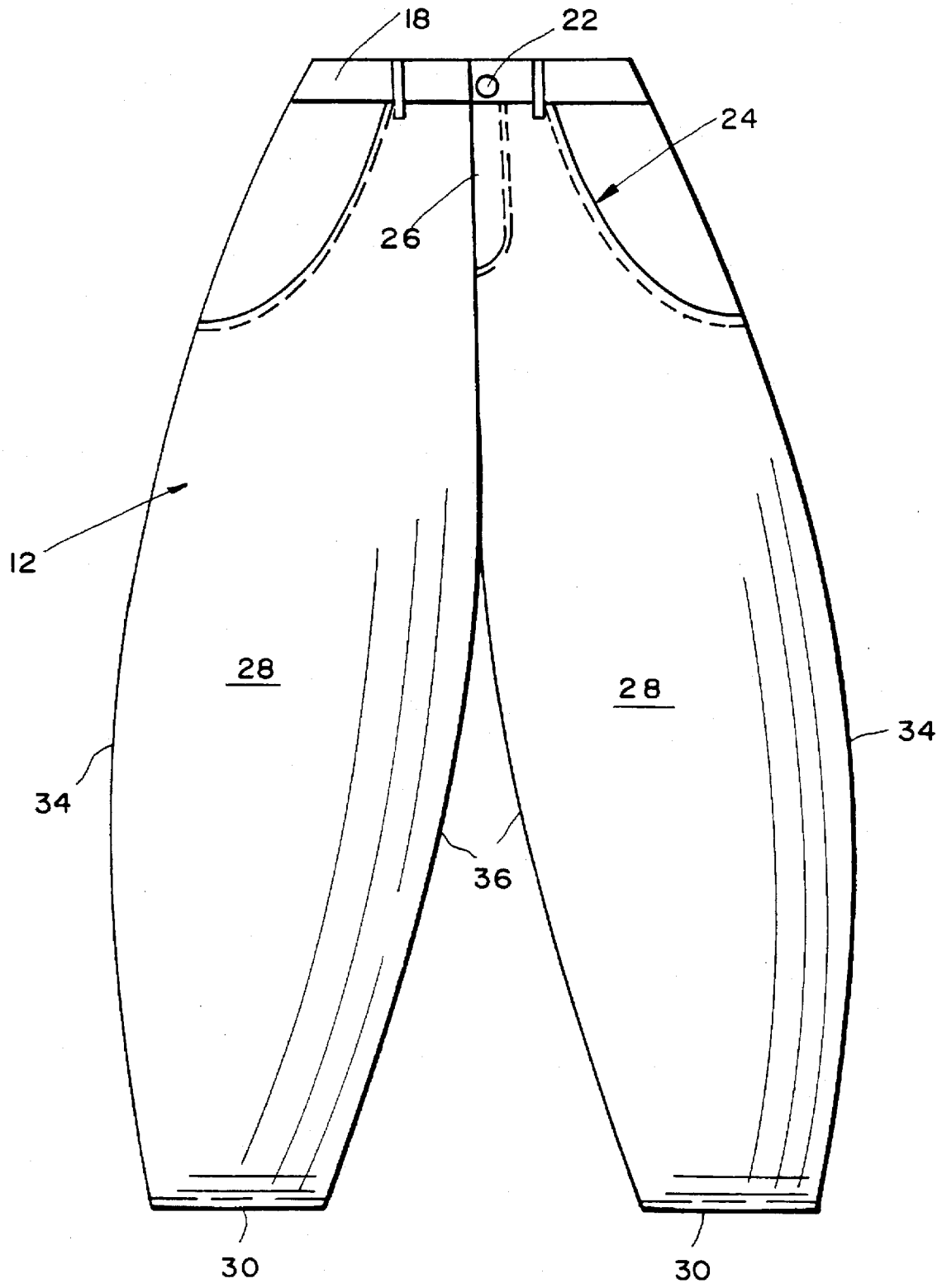
FIG. 5 is a front elevational view of the pants of FIG. 1.
Figure 6:
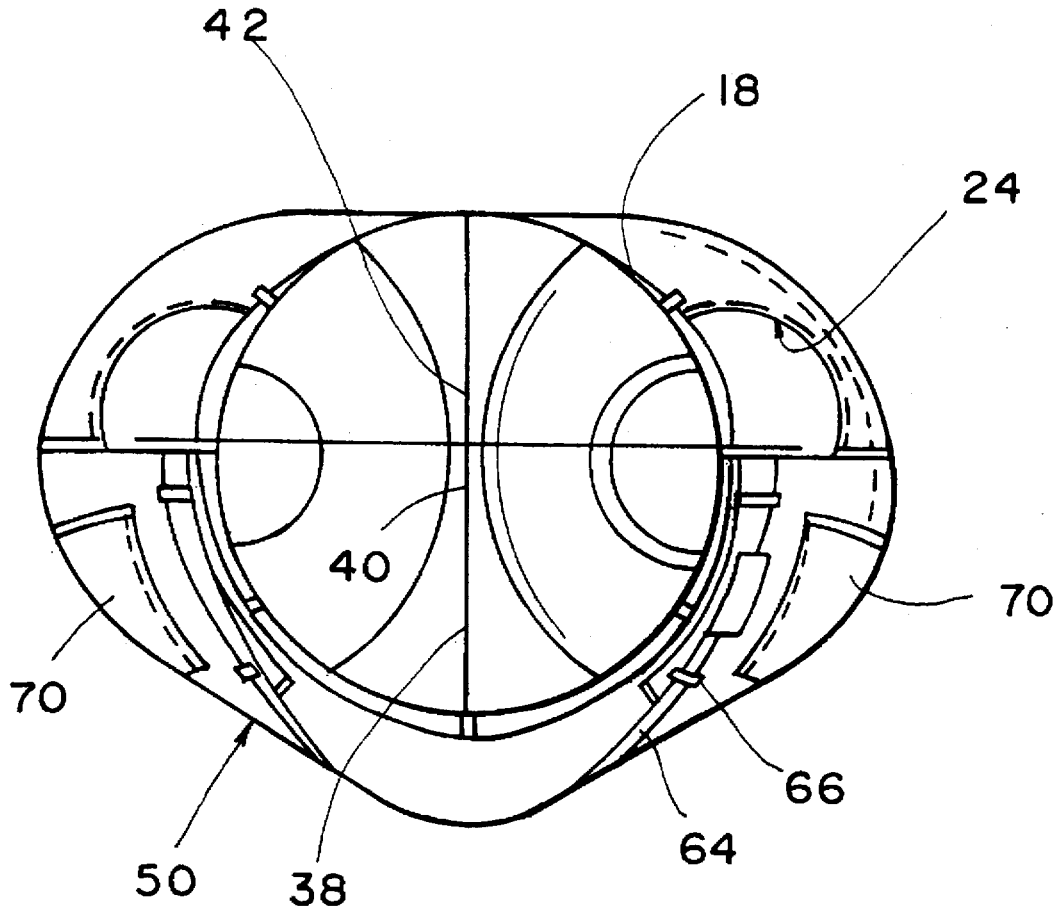
FIG. 6 is a top view of the pants of FIG. 1.
Figure 7:
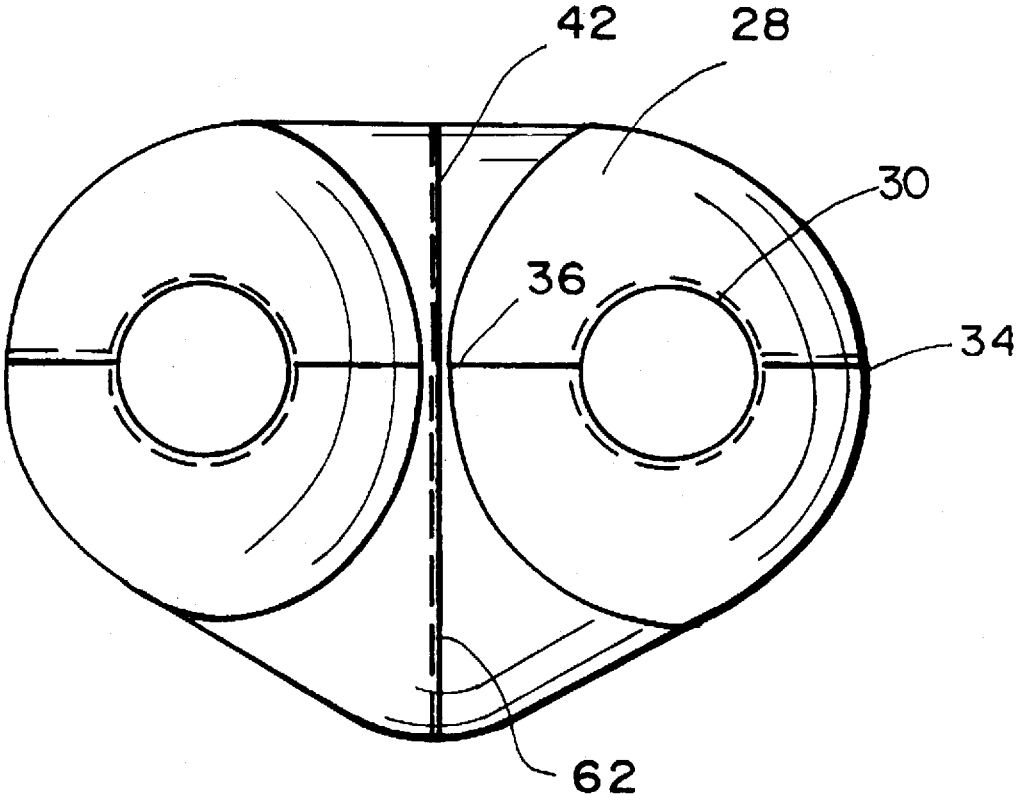
FIG. 7 is a bottom view of the pants of FIG. 1.
Figure 8:
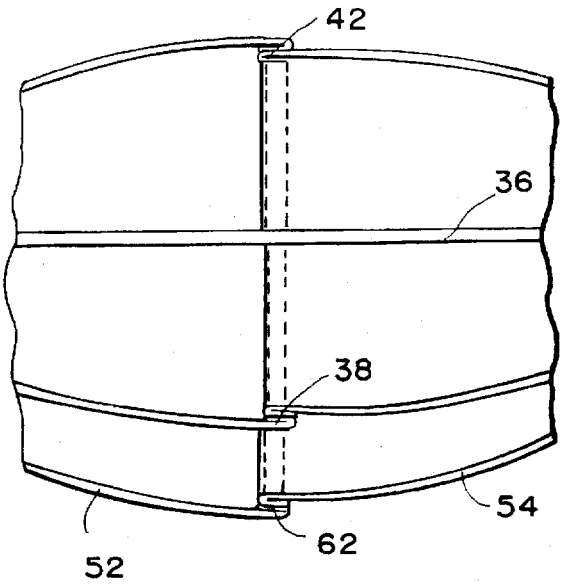
FIG. 8 is a fragmental horizontal sectional view taken substantially upon a plane passing along section line 8—8 on FIG. 4 illustrating the relationship of the double bottom to the existing pants in the crotch area.
Figure 9:
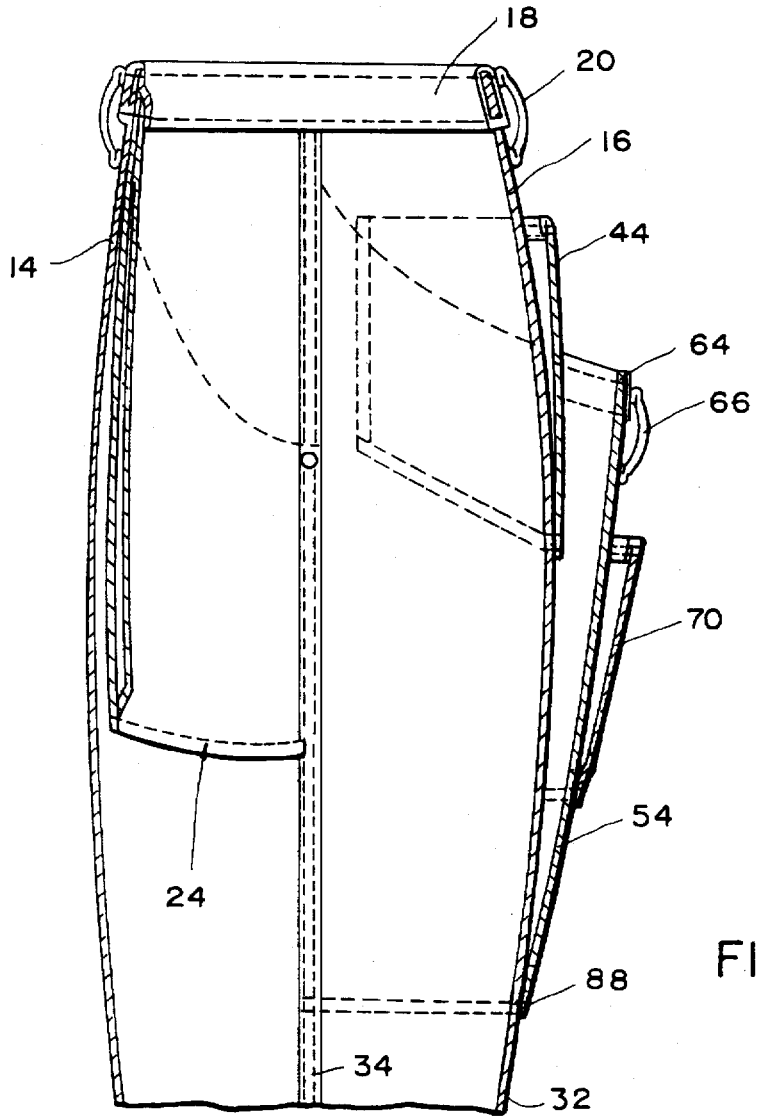
FIG. 9 is a vertical sectional view taken substantially upon a plane passing along section line 9—9 on FIG. 4 illustrating the relationship of the components of the double bottom to the components of the existing pants.

In describing the preferred embodiment of the present invention as illustrated in the drawings, specific terminology will be resorted to for the sake of clarity. However, the invention is not intended to be limited to the specific embodiment illustrated and terms so selected; it being understood that each specific term includes all technical equivalents which operate in a similar manner to accomplish a similar purpose.

Referring now to the drawings, the sagging double bottom pants of the present invention is generally designated by reference numeral 10 and includes a conventional pair of trousers, pants, jeans or dungarees generally designated by reference numeral 12. The size, shape and fabric material from which the original pants 12 are constructed can be varied and is constructed in a conventional manner. As shown, the original pants 12 include a front lower torso covering portion 14, a rear torso covering portion 16 provided with a waistband 18 at the upper end. The waistband includes spaced belt loops 20 and a securing button, snap, or other fastener 22 to connect the forward ends of the waistband together. The front covering portion 14 also includes pocket structures generally designated by reference numeral 24 of a conventional type and a conventional fly 26 to enable a wearer to don or remove the pants.

The forward torso covering portion 14 includes depending leg portions 28 terminating in a hem 30 at the lower end, and the rear torso covering portion 16 includes similar leg covering portions 32 which are joined to the front leg covering portions 28 along side seams 34 and along inseams 36 in a conventional manner. The rear torso covering portion 16 includes a rear center seam 38 connected with the inseams 36 in the crotch area 40 and is provided with a front center seam 42 extending to the fly 26. The fly can be opened and closed by any suitable fastening structure including buttons, snaps, zipper or the like. The rear torso covering portion 16 also includes pockets 44 which are attached to either or both of the right and left outer sides of the fabric from which the rear torso covering portion 16 is constructed with the pockets either being patch pockets or slash pockets depending upon the type of pants being constructed.

All of the aforementioned components of the conventional pants 12 are existing garment structure with the fabric materials used being selected from various types of fabrics depending upon the appearance characteristics and wear characteristics desired. The original pants 12 are conventional as to their shape, size and material. Preferably, however, the present invention is adapted for jeans, and most preferably, for bluejeans.

The sagging double bottom generally designated by reference numeral 50 is attached to the seat and preferably upper leg area of the existing pants 12 and includes a pair of rear panels 52 and 54 each of which includes lower leg portions 56 attached to the upper end portion of the leg portions 32 of the existing pants 12. The attachment of the lower leg portions 56 to the leg portions 32 is preferably along a transverse, horizontal seam or stitching 58 or the like; however, any suitable seam or stitching can be utilized which provides the same sagging double bottom appearance as provided by the construction illustrated.

The outer side edge of each of the panels 52 and 54 is preferably incorporated into the side seam 34 along the entire vertical length of the panels 52 and 54. The inner edges of the leg portions 56 of the panels 52 and 54 include an inseam 60 preferably incorporated into the inseam 36 up to the crotch area where the inseam 36 of the existing pants and the inseam 60 incorporated therein joins with the center seams 38 and 42 of the existing pants 12 in the crotch area 40. The inside edges of the portions of the two panels 52 and 54 form a separate center seam 62 from the crotch area 40 upwardly to an auxiliary waistband 64 formed along the top edge of panels 52 and 54.

The auxiliary waistband 64 is preferably of the same construction as the waistband 18 and thus includes belt loops 66 thereon. The ends of the auxiliary waistband 64 are connected into the side seams 34 at 68 which is a point spaced below the waistband 18 as illustrated in the drawings. The length of the auxiliary waistband 64 is greater than the straight line distance between the side seams 34. Further, the ends of the auxiliary waistband are oriented downwardly in an angular direction from the side seams 34. When worn by the wearer, this construction provides a sagging, arcuate auxiliary waistband 64 spaced below the waistband 18 and extending in an arcuate manner with the center of the auxiliary waistband 64 being located below the outer ends thereof where they are interconnected with the side seams 34. This same construction may also be incorporated into shorts type garments.

Each of the panels 52 and 54 which form the double bottom also includes an upwardly opening compartment 70 spaced below the auxiliary waistband 64 with the pockets being preferably attached compartment secured by stitching 72 to the fabric forming the panels 52 and 54 in the same manner to match pockets 44 of the existing trousers or pants. The waistband 64 includes a label 74 of conventional construction secured thereto which may be of plastic, leather or other material and can be used as a belt loop in order for the identifying trademark for the pants to be displayed. The waistband 18 may also be provided with a similar label.

The construction of the double bottom 50 provides a compartment between the double bottom 50 and the covered rear surfaces of the existing pants 12. Access to this compartment is provided by the excess length of the auxiliary waistband 64 and the dimensional characteristics of the panels 52 and 54. The compartment is peripherally continuous from side seam to side seam of the pants 10 downwardly to the point of connection between the center seam 62 and its juncture with the center seams 38 and 42 in the crotch area 40. The compartment then is continuous in each leg portion down to the seam 38 and between the side seam 34 and the inseam 60 which is incorporated into the inseam 36 in the existing pants 12.

With this construction, the sagging auxiliary waistband and double bottom 50 provides the appearance characteristics similar to the current practice of wearing pants which are too large so that the waistband of the pants can sag from its normal position. However, since the present invention incorporates a conventional existing waistband for the pants, there is no possibility that the pants can accidentally fall or be pulled downwardly without actually unfastening the conventional waistband 18 and opening the fly in a well known and conventional manner. Thus, the sagging double bottom pants of this invention enables a fashion statement to be made and includes all the attributes of such a statement without risking the unwanted exposure of portions of the human anatomy normally covered by conventional pants.

The foregoing is considered as illustrative only of the principles of the invention. Numerous modifications and changes will readily occur to those skilled in the art. For example, while the preferred form of the invention contemplates that the double bottom 50 be made of a similar material and color as the existing pants 12, it may be desirable to utilize a different fabric or color without departing from the present invention. Therefore, it is not desired to limit the invention to the exact construction and operation shown and described. All suitable modifications and equivalents may be resorted to which fall within the scope of the invention as disclosed and claimed.

What is claimed as new is as follows:

1. A sagging double bottom pants comprising a pair of pants including front and rear lower torso covering portions having a waistband at the upper edge thereof and depending leg covering portions to form pants, an added double bottom of fabric material attached to the pants and covering a portion of the rear torso covering portion and leg covering portions, said double bottom having an upper edge provided with an auxiliary waistband oriented below and in downwardly curved arcuate configuration in relation to the waistband of the pants to provide access between rear surfaces of the pants and the added double bottom.

2. The pants as defined in claim 1 wherein said double bottom includes a pair of panels having outer edges incorporated into side seams of the pants, said auxiliary waistband having end portions incorporated into the side seams of the pants below the waistband of the pants.

3. The pants as defined in claim 2 wherein said panels forming the double bottom include a center seam extending from the auxiliary waistband downwardly to the crotch portion of the pants with the center seam between the panels being connected to a center seam in the pants at the juncture between the center seam of the pants and inseams of the pants.

4. The pants as defined in claim 2 wherein said panels forming the double bottom include depending portions overlying a portion of the leg covering portion of the pants, said depending portions of the panels including side edges incorporated into the side seams of the pants and inner edges incorporated into the inseams of the pants and a bottom edge stitched to the leg covering portions of the pants thereby forming a bottom for a compartment defined between the double bottom and the rear surfaces of the pants with access to the compartment being provided by the auxiliary waistband.

5. The pants as defined in claim 4 wherein at least one of the panels forming the double bottom includes a pocket secured to an exterior surface of the panel, said auxiliary waistband including belt loops and a label member attached thereto thereby enabling the auxiliary waistband to sag below the waistband of the pants to simulate a sagging waistband on pants without the risk of the pants falling downwardly in relation to a wearer.

6. A double bottom structure for incorporation into a pair of pants, said double bottom including an upper edge that simulates a waistband for observation by others while a conventional waistband on said pants is oriented in a normal waist encircling relation, said upper edge being of arcuate configuration, said double bottom having a periphery attached to the pants with the arcuate waistband being free to provide access to a compartment between the pants and double bottom.

7. The double bottom as defined in claim 6 wherein said double bottom includes at least one pocket secured to an exterior surface thereof and said upper edge includes belt loops and a label member attached thereto.

8. The double bottom as defined in claim 6 wherein at least a portion of the periphery of said double bottom is incorporated into side seams and at least one seam that meets at a crotch area of said pants, and said upper edge includes end portions incorporated to the side seams of said pants and oriented below and in downwardly curved arcuate configuration in relation to the waistband of said pants.

9. A pants or shorts construction having a sagging bottom effect which comprises conventional fabric pants or shorts having a rear portion, a waistband at the upper edge thereof, side seams, and depending leg covering portions, an added double bottom of fabric material which is attached to the pants or shorts and covering said rear portion, said double bottom having an upper edge provided with an auxiliary waistband having end portions incorporated into said side seams of the pants or shorts and oriented below and in downwardly curved arcuate configuration in relation to the waistband of the pants, and said double bottom also including depending portions overlying at least a portion of the leg covering portions of said pants or shorts, said bottom depending portions including side edges incorporated into the side seams of the pants or shorts and inner edges incorporated into inseams of the pants or shorts and a bottom edge attached to the leg covering portions of the pants or shorts.

10. The pants or shorts as defined in claim 9 wherein said double bottom includes on an exterior surface at least one pocket and said auxiliary waistband simulates the waistband of said pants or shorts.

11. A pants or shorts construction having a sagging double bottom effect comprising conventional fabric pants or shorts having a rear portion and a waistband at the upper edge thereof, a double bottom attached to said pants or shorts which covers a substantial portion of said rear portion, said double bottom having an upper edge provided with an auxiliary waistband that is free of said pants or shorts to provide access to a compartment between said double bottom and said pants or shorts.

12. The pants or shorts as described in claim 11 wherein said pants or shorts include side seams and said auxiliary waistband has end portions incorporated into said side seams and oriented below and in downwardly curved arcuate configuration in relation to the waistband of the pants or shorts.

13. The pants or shorts as described in claim 11 wherein said auxiliary waistband is of arcuate configuration and provided with belt loops.

* * * * *